United States Patent [19]

Hoene et al.

[11] Patent Number: 4,795,866

[45] Date of Patent: Jan. 3, 1989

[54] VACUUM TUBE SWITCH WHICH USES LOW TEMPERATURE SOLDER

[75] Inventors: Ernst L. Hoene; Roman Renz; Klaus Gessner, all of Berlin, Fed. Rep. of Germany

[73] Assignee: Siemens Aktiengesellschaft, Berlin and Munich, Fed. Rep. of Germany

[21] Appl. No.: 148,719

[22] Filed: Jan. 26, 1988

[30] Foreign Application Priority Data

Feb. 4, 1987 [DE] Fed. Rep. of Germany ..... 3703326

[51] Int. Cl.[4] ..... H01H 33/66

[52] U.S. Cl. ..... 200/144 B; 228/263.18; 445/40

[58] Field of Search ..... 200/144 B

[56] References Cited

U.S. PATENT DOCUMENTS 4,334,133 6/1982 Gebel et al. ..... 200/144 B

FOREIGN PATENT DOCUMENTS 0129080 12/1984 European Pat. Off. .
1957812 11/1970 Fed. Rep. of Germany .
2659871 10/1977 Fed. Rep. of Germany .
1281938 7/1972 United Kingdom .

*Primary Examiner*—Robert S. Macon

[57] ABSTRACT

A vacuum switch tube wherein at least one part which separates the interior of the tube from the environment is soldered to the housing of a vacuum switch tube so as to be vacuum-tight with a soft solder 6 which has a melting point which lies below 400° C. The invention is suitable for vacuum switch tubes which do not have a pump stem, and particularly for protected tubes.

15 Claims, 2 Drawing Sheets

VACUUM TUBE SWITCH WHICH USES LOW TEMPERATURE SOLDER

BACKGROUND OF THE INVENTION

1. Field of the Invention

The present invention relates in general to a vacuum tube switch wherein the housing is composed of electrically nonconductive parts and metal parts and wherein at least one part of the vacuum tube switch separates the interior of the tube from the environment is vacuum-tight soldered with a soft solder that has a melting point below 400° C.

2. Description of the Prior Art

A vacuum tube switch is disclosed in German AS No. 26 59 871. Various solder materials having melting points between 605° C. and 906° C. are recited therein as solder materials and their suitability for soldering various materials of vacuum switch tubes. A melting point between 605° C. and 835° C. is recited as the "low" melting point in German AS No. 26 59 871. German No. 1,957,812, British No. 1,281,938 and European Patent Application No. 0,129,080 also disclose various brazing or solder arrangements.

SUMMARY OF THE INVENTION

An object of the present invention is to provide an inexpensive vacuum switch tube which is especially suitable for mass production and wherein at least one part of the vacuum switch tube which separates the interior of the tube from the environment is soldered so as to be vacuum tight with a soft solder that has a melting point which falls below 400° C.

It is a feature of the present invention to use soft solders which have a melting point below 400° C. that can be used for vacuum switch tubes without increasing the breaking capacity or the useful life of the device. Soft soldering can be advantageously utilized in protected tubes for medium or low voltage. The invention allows an especially economically manufacturing technique for vacuum switch tubes without requiring exhaust pipes. Due to the soft soldering, the temperature stress on the housing is reduced and mechanical stresses that occur during cooling after the soldering remain very low. This ensures the utilization of materials that are not thermally matched without presenting any sealing problems and considerable cost reduction is thus possible.

The soft solder which is used should have a melting point of the most of about 300° C. High purity tin solder is especially suitable since this has an extremely low vapor pressure at 300° C.; and a soft solder of $Sn_{50}PbCu$ which has a vapor pressure at 300° C. below $10^{-13}$ bar is also especially suitable. The deposition of vapor onto insulating housing parts can be avoided when using the solders and, thus, a very high insulation of the finished tube is assured.

Soft solder is also suitable for metal to ceramic connections and the soft solder surfaces on the ceramic are thereby advantageously metallized.

The thermal coefficient of expansion of the metal parts need not be matched to that of the insulator parts when using a soft solder connection. As a matter of fact, the soft solder can be plastically deformed to such an extent that different coefficients of thermal expansion will be compensated. Thus, for example, copper parts can be soft soldered to ceramic members without difficulty and butt soldering as well as planar soldering to the end face of the ceramic member are possible. Vacuum switch tubes soldered according to the invention can be advantageously constructed without the use of a exhaust pipe. The exhaust pipe which is very sensitive to mechanical stress is thus replaced with a soft solder arrangement. This simplifies the construction and handling of the vacuum switch to a significant degree and reduces the risk of damaging when handling the tubes.

The strength of the soft solder is also adequate for soldering the overall housing of vacuum switch tubes. This results in a considerable saving in cost and especially in relatively inexpensive protective tubes.

A method wherein the soft soldering occurs in a vacuum free of oxide and free of fluxing agents and wherein the soldering temperature lies below 400° C. and the melting temperature of the solder is not more than 100° C. below the soldering temperature and wherein a pressure of less than $10^{-6}$ bar prevails during the soldering process is advantageous for the manufacture of vacuum tube switches of the invention. Good soldering is achieved in this method and a supression of interfering evaporation of solder metal is also achieved.

Silver solder, for example, silver tin solder is advantageously employed in order to avoid disturbing oxide layers on the solder. It is also advantageous to free the solder surfaces and the solder of oxides immediately before the soldering occcurs.

The method is advantageously improved in that the soft solder is placed onto the prefabricated vacuum switch tube in the form of a corrugated ring and a cover is placed on the solder ring and a plurality of vacuum switch tubes are evacuated during one work cycle and are soldered so that they are tight in a vacuum. For high demands, it is recommended that the copper parts be silvered before the soft soldering. A durable and reliable connection to ceramic parts is achieved in that the ceramic parts are metallized before the soft soldering.

It is sufficient in tubes of the invention that the switch tubes are baked at only about 200° C. to 250° C. and the soft soldering is thus produced during the same work cycle.

Other objects, features and advantages of the invention will be readily apparent from the following description of certain preferred embodiments thereof taken in conjunction with the accompanying drawings although variations and modifications may be effected without departing from the spirit and scope of the novel concepts of the disclosure, and in which:

DESCRIPTION OF THE PREFERRED EMBODIMENTS

Figure 1:
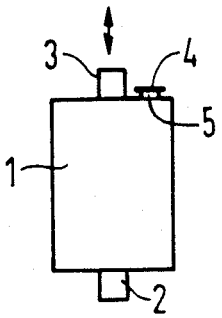
FIG. 1 illustrates a vacuum switch tube with a metal cover that is soldered onto an opening in the housing.

FIG. 1 illustrates a vacuum switch tube 1. Contact pins 2 and/or 3 can be moved in the direction of the arrow when switching occurs. A metal cover 4 is soldered onto an opening 5 formed in the housing. The metal cover 4 is only slightly mechanically stressed, but this embodiment is also suited for vacuum switch tubes which are also highly mechanically stressed. The cover 4 may be a simple solder plug in an opening.

Figure 2:
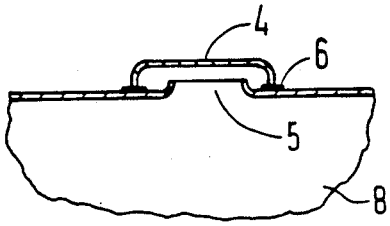
FIG. 2 illustrates partly cut-away sectional view of modification of the invention.
Figure 3:
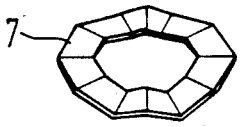
FIG. 3 illustrates a perspective view of a solder ring according to the invention.
Figure 5:
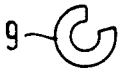
FIG. 5 is a plan view of a modified solder ring of the invention.

For larger switch tubes, the embodiment illustrates in FIG. 2 can be utilized. Solder 6 in the form of a corrugated solder ring 7 such as shown in FIG. 3 is placed under a generally cup-shaped cover member 4 which covers the opening 5 and the cover member 4 is soldered by the solder 6 to the housing so as to seal the interior 8. Thus, an opening to the interior of the tube is preserved during the evacuating process and the tube can be completely evacuated. Other forms of the solder ring can also be used instead of the corrugated solder ring 7 which may be in the form of a foil as long as it leaves an adequate cross-section portion free between the interior 8 of the switch tube and the environment. For example, a solder ring 9 of generally C-shaped shown in FIG. 5 can be utilized which represents a sector of a ring.

Figure 4:
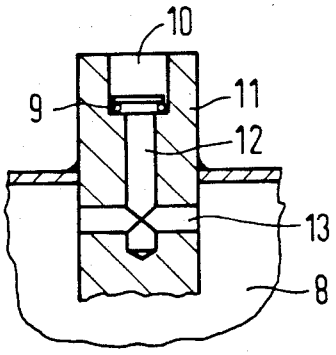
FIG. 4 is a partially cut-away view of a modified form of the invention.

FIG. 4 illustrates a solder ring 9 mounted in a bore 10 of a contact pin 11 which is mounted in the housing wall. Communication with the interior space of the tube is made with smaller bores 12 and 13 which extend between the interior 8 and the bore 10. A cover cap may be soldered with the solder 9 to seal the bore 12 after evacuation has occurred. The arrangement of FIG. 4 is especially advantageous in small tube types wherein there are not adequate surfaces except the contact pin 11 are available for the application of a cover.

Figure 6:
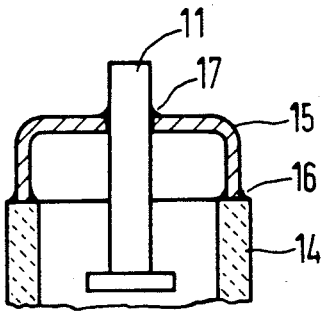
FIG. 6 is a partially cut-away sectional view showing solder connections between metal and insulator parts of the housing.

FIG. 6 illustrates an embodiment where a metal cap-shaped member 15 is butt soldered to a ceramic portion 14 of the housing. The solder connection 16 is produced with soft solder. The fixed contact pin 11 extends through the metal cap 15 and a solder connection 17 is made between the fixed contact pin and the cap 15 as shown by the solder connection 17.

Figure 7:
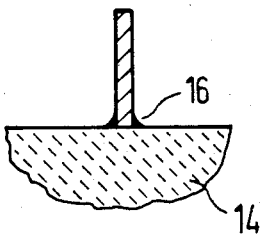
FIG. 7 illustrates sectional view of a modification of the solder connection.

FIG. 7 illustrates a solder connection between a ceramic member 14 and plate by a solder connection 17 which can be a V-shaped soft soldering joint.

Figure 8:
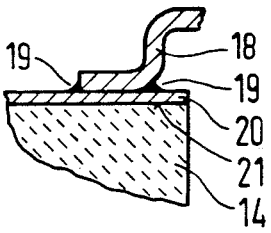
FIG. 8 is a partial sectional view of a modified form of the solder connection.

A planar soldering connection is illustrated in FIG. 8 which can be utilized instead of the butt soldering illustrated in FIG. 6 and in FIG. 8, a V-shaped soft solder seam 19 which joins the flange 18 to the end face of the ceramic part can be utilized at both ends of the flange 18. The connection advantageously occurs by using a metal layer 20 which has previously been attached to the end base 21 of the ceramic member 14.

In the embodiments illustrated in FIGS. 1-5, the housing of the vacuum switch tube is advantageously previously prefabricated. The housing can thus be manufactured using standard hard solder connections. The baking and soldering for an entire series of vacuum switch tubes can then occur simultaneously in the same vacuum without special equipment being required for this purpose. The pressure of less than $10^{-7}$ bar for soft soldering at 300° C. is recommended in this embodiment.

Copper is especially suitable as the material for the metal parts and a ceramic material that contains at least 80% $Al_2O_3$ is especially suitable as the insulating material. The ceramic is preferably metallized in the region of the solder surfaces. The copper is advantageously silvered so as to avoid the formation of oxides.

Glass or porcelain can also be utilized as the insulating materials used in the structures of the invention.

Although the invention has been described with respect to preferred embodiments, it is not to be so limited as changes and modifications can be made which are within the full intended scope of the invention as defined by the appended claims.

We claim as our invention:

1. A vacuum switch tube which has a housing formed of electrically insulator and metal parts, characterized in that at least one part of the vacuum switch tube that separates the interior of the tube from the environment is soldered so as to be vacuum-tight using a soft solder which has a melting point which is below 400° C.

2. A vacuum switch tube according to claim 1, characterized in that said soft solder has a melting point not greater than about 300° C.

3. A vacuum switch tube according to claim 2, characterized in that said soft solder is a high-purity tin solder.

4. A vacuum switch tube according to claims 1 or 2, characterized in that said soft solder is a $Sn_{50}PbCu$ solder which has a vapor pressure at 300° C. of less than $10^{-13}$ bar.

5. A vacuum switch tube according to claims 1 or 2 or 3, characterized in that said housing is prefabricated; and said housing is formed with an opening, said housing opening closed by a cover; and said cover is soldered to said housing over said opening with soft solder.

6. A vacuum switch tube according to claims 1 or 2 or 3, characterized in that said tube has metal-to-ceramic connections which are made with soft solder.

7. A vacuum switch tube according to claims 1 or 2 or 3, characterized in that the temperature coefficient of expansion of the metal part and the insulator part which are soldered together are not the same.

8. A vacuum switch tube according to claim 1 or 2 or 3, characterized in that said switch tube has no exhaust pipe.

9. A method for manufacturing a vacuum switch tube comprising the steps of soft soldering parts in a vacuum which is free of oxide and fluxing agents and the soldering temperature is below 400° C.; and wherein the melting temperature of the solder is not more than 100° C. lower than the soldering temperature; and a pressure of less than $10^{-6}$ bar is maintained during the soldering process.

10. A method according to claim 9, characterized in that silvered solder is used.

11. A method according to claims 9 or 10, including the step of freeing the surfaces to be soldered and the solder of oxides immediately before soldering.

12. A method according to claims 9 or 10 including the steps of placing soft solder onto the prefabricated vacuum switch tube which is in the form of a corrugated ring and placing the cover thereupon; and a plurality of vacuum switch tubes are evacuated and soldered in the vacuum during one work cycle.

13. A method according to claims 9 or 10 comprising the step of silvering the copper parts before soft soldering.

14. A method according to claims 9 or 10 comprising the step of metallizing the ceramic part before soft soldering.

15. A method according to claims 9 or 10 comprising the step of baking the switch tube at only 200° C. to 250° C.' and the soft soldering is done in the same work cycle.

* * * * *